US006516471B1

(12) United States Patent
Baumann

(10) Patent No.: US 6,516,471 B1
(45) Date of Patent: Feb. 11, 2003

(54) BALL GLOVE

(76) Inventor: Mark Baumann, 16433 Audubon Village, Wildwood, MO (US) 63040

( * ) Notice: Subject to any disclaimer, the term of this patent is extended or adjusted under 35 U.S.C. 154(b) by 0 days.

(21) Appl. No.: 10/082,796

(22) Filed: Feb. 25, 2002

Related U.S. Application Data

(60) Provisional application No. 60/336,491, filed on Nov. 2, 2001.

(51) Int. Cl.[7] ..... A41D 13/08

(52) U.S. Cl. ..... 2/19

(58) Field of Search ..... 2/19, 16, 20, 159, 2/160, 161.1, 161.6, 411, 416; 24/578.1, 578.13, 904

(56) References Cited

U.S. PATENT DOCUMENTS

| | | | | |
|---|---|---|---|---|
| 3,623,163 A | * | 11/1971 | Latina | 2/19 |
| 4,453,272 A | | 6/1984 | Miyake et al. | |
| 4,660,240 A | | 4/1987 | Hutton et al. | |
| 4,899,466 A | | 2/1990 | Skaja | |
| 4,908,880 A | * | 3/1990 | Clevenhagen | 2/19 |
| 5,346,208 A | | 9/1994 | Wood, Sr. | |
| 5,357,634 A | * | 10/1994 | Aoki | 2/161.1 |
| 5,379,460 A | * | 1/1995 | Aoki | 2/161.1 |
| 5,448,775 A | | 9/1995 | Yamada et al. | |
| 5,577,306 A | | 11/1996 | Gold | |
| D376,675 S | | 12/1996 | Yamada et al. | |
| 5,678,245 A | | 10/1997 | Rector et al. | |
| 5,974,587 A | | 11/1999 | Murai | |
| 6,088,838 A | | 7/2000 | Sontag | |
| 6,098,208 A | | 8/2000 | Cordon | |
| 6,145,170 A | | 11/2000 | Bernard et al. | |
| 6,249,915 B1 | | 6/2001 | Hang | |
| 6,256,792 B1 | | 7/2001 | MacDonald | |

* cited by examiner

*Primary Examiner*—Gary L Welch
(74) *Attorney, Agent, or Firm*—Lewis, Rice & Fingersh, L.C.

(57) ABSTRACT

A ball glove for use in games such as baseball and softball wherein the webbing of the glove is suspended in the crotch of the glove through the use of at least one energy absorbing connector. The energy absorbing connector being capable of absorbing more energy from an impacting ball than a traditional rigid connector can absorb. The energy absorbing connector may absorb energy through a plurality of mechanisms whether mechanical, electrical, chemical or others. In particular, an energy absorbing connector which dissipates energy through resisted motion is discussed.

7 Claims, 8 Drawing Sheets

BALL GLOVE

CROSS REFERENCE TO RELATED U.S. APPLICATIONS

This application claims priority to U.S. Provisional Patent Application Ser. No. 60/336,491 filed Nov. 2, 2001, the entire disclosure of which is herein incorporated by reference.

BACKGROUND OF THE INVENTION

1. Field of the Invention

This disclosure relates to the field of ball gloves. In particular, to gloves for use in ball games such as baseball or softball.

2. Description of the Related Art

Baseball is a sport played by both young and old many people in a multitude of countries and under a multitude of conditions. The sport is played from the finally groomed fields of the Major Leagues, to playgrounds, to pickup games on sandlots or fields. Baseball players need to have a variety of different skills to perform well on the diamond. Most players are expected to hit well, as well as to field hit balls, and throw and catch balls accurately to get players out at base. Fielding or otherwise catching a baseball generally involves an understanding of, and the effective use of, a ball glove.

The first step of catching a ball with a ball glove is to understand how a ball is caught with the bare hands. When the ball comes in contact with the palm of the hand, some of its energy is stored by compression of the ball or in the structures of the palm of the hand. If the hand is held rigid when the ball hits, this stored energy will be reconverted into motion of the ball away from the hand and the ball will bounce off the hand. This is similar to the dynamics used for batting the ball as the bat and ball both compress to store energy (from both the ball's motion and the bat's swing) which is then reconverted into the ball's motion after the ball is struck. In fielding, however, the hand is not held rigid, but instead when the ball hits the hand, the hand is moved with the ball to dissipate some of the ball's force through the muscle action of the arm and associated structures. Further, the fingers are closed about the ball after it impacts in the palm of the hand to assist in securing the ball. Through these mechanisms, the ball's force is dissipated, and when the ball starts to rebound, the fingers cage the ball in the hand and friction and/or surface tension prevents the ball from moving forward, keeping the ball in the hand.

Catching a thrown ball bare-handed can often hurt or sting the hand because of minor damage caused to the structures of the hand that absorb some of the force of the ball. However, in baseball the ball, particularly when batted, can travel with tremendous energy and hit with a large amount of force, it is therefore undesirable to regularly catch batted balls with the bare hands as significant damage can be caused by the ball. The ball glove is therefore designed to be an extension of the hand which protects the hand from the force of the ball by using the unfeeling structures of the glove to absorb some of the force. Further, the glove provides for a larger area upon which the ball can be caught improving the probability of being able to catch it at all. The glove is also designed to be less elastic than the hand to absorb additional force from the ball upon impact. When using a glove, a similar type of motion is used as when a ball is caught barehanded. A baseball glove generally has a web suspended between the thumb and index finger (an area called the crotch) which is designed to be impacted by the ball and absorb the impact of the ball through the inelastic collision of the web with the ball as well as by the motion of the muscles in the arm and wrist as the glove is pushed (using a lever action) by the ball and pivots at the edge of the palm and the player moves their hand and arm in the catch. This type of impact allows for a significant amount of the ball's force of motion to be dissipated (essentially used up by conversion into other forms of energy such as heat, resistance and other motion). The glove is then generally closed on the ball after impact to prevent the ball from popping out (or rolling out under the force of gravity) from the force that gets returned to it by the impact.

The difficulty of fielding lies in getting accustomed to using the glove. In bare hand catching, nerves in the palm of one's hand trigger when the ball has hit the palm and the hand should be closed, something that most people can do almost intuitively. The glove, however, is not a part of the body and it must be learned when to close the glove after the ball hits in the crotch to prevent the ball from bouncing off the glove and turning a catch into a dropped ball. This is particularly true because the ball hits in an area of the glove that is designed to not transmit as much force to the hand (as it is not in direct contact with the palm), therefore there are not the same nerve cues to close the hand when the ball hits.

Further, the glove is also fairly rigid when built. Gloves are regularly constructed of leather and need to be "broken-in" before they can be used to their full potential. Breaking-in a glove requires the leather to be softened and broken down through repeated use so that the hand does not need to provide as much force to close the glove as it does when the leather is new. During this breaking-in time, while the glove is new, more force is required to close the glove and the fingers generally take a longer time to close on the ball. This results in a two-fold problem for younger or more inexperienced players. Generally, these players will have newer equipment as they will not have had time to break-in their equipment yet and do not have the facilities to have others break it in for them. Further, since these players are generally newer to the game (and often generally younger), the players may not have the hand strength of an experienced adult player, meaning it is even harder for them to close a newer glove.

Understanding when to close the glove is also a learned skill, and even Major League professional ball players still do not always get their glove closed in time and occasionally drop a ball they should have caught. The time the ball is against the web is minimal, usually just a fraction of a second. The more stored energy that can be translated by the ball into motion, also contributes to the ball's likelihood of leaving the glove. A baseball is designed to lose a large amount of energy in the collision with the glove (an inelastic collision as compared to the collision between two billiard balls, for instance, which is designed to transmit energy very effectively in a highly elastic collision) meaning that when the ball hits the glove it is likely to only leave with a fraction of the energy it arrived with, but the ball is likely to arrive with a tremendous initial energy. For this reason, the ball glove is also generally designed to have a partially recessed or "cupped" shape so a ball with insufficient energy to clear the "cup" or recess cannot escape. This shape is often referred to as the pocket of the glove. Therefore, a light toss can often be caught in the glove without even closing the fingers as there is insufficient energy to allow the ball to escape from the pocket of the glove upon rebound as the structures of the glove absorb sufficient energy to eliminate the need for closing the fingers.

Because of these dynamics, the ability to catch a ball is improved if the time the ball is in the glove is increased, if the glove absorbs more of the energy of the ball upon impact, and/or if the distance the ball has to travel to leave the pocket of the glove is increased. The last of these is generally not allowed by the regulations governing professional baseball play, but the first two are generally unregulated. Further, changes may be of particular benefit to young and/or inexperienced players as these players have not yet mastered the timing for catching the ball, even if a glove is not licensed for professional play. A younger, non-professional player may be able to learn skills from a modified glove, which they can translate to a traditional glove for competitive play or as their experience grows.

SUMMARY

Because of these and other previously unknown problems in the art, disclosed herein is a ball glove for use in games such as baseball and softball wherein the webbing of the glove is suspended in the crotch of the glove through the use of at least one energy absorbing connector. The energy absorbing connector being capable of absorbing more energy from an impacting ball than a traditional rigid connector can absorb. The energy absorbing connector may absorb energy through a plurality of mechanisms whether mechanical, electrical, chemical or others. In particular, an energy absorbing connector which dissipates energy through resisted motion is discussed.

In an embodiment, there is disclosed a ball glove comprising: a hand portion including a thumb stall, an index finger stall, and a crotch between the thumb stall and the index finger stall; a pin attached to the hand portion; a webbing; and a pin harness attached to the webbing, the pin harness slideably engaging the pin and positioned so as to suspend the webbing in the crotch.

In an embodiment, the pin harness allows for generally linear movement of the pin within a slot and/or the pin also slideably engages at least one pin resistance portion. The at least one pin resistance portion may be arranged so as to have a "V" shape.

In an embodiment, there may be slideable interaction between the pin and the pin harness requires a predetermined amount of force to accomplish which in turn may be generated by a baseball impacting said webbing and/or the force from the baseball may be converted into force to accomplish said slideable interaction.

In another embodiment, disclosed herein is a ball glove comprising: a hand portion including a thumb stall, an index finger stall, and a crotch between the thumb stall and the index finger stall; a webbing; and an energy absorbing connector suspending the webbing in the crotch of the hand portion wherein when a ball is caught in the ball glove, the webbing moves to a new physical position and the energy absorbing connector expends energy through the movement.

In yet another embodiment, the energy absorbing connector expends energy by forcing a pin through a material and/or the webbing may be separated or separable from said hand portion.

In yet another embodiment, the energy absorbing connector includes a strap, which can either aid in suspending said webbing in said crotch, or aid in removing said webbing from said crotch and/or the energy absorbing connector may include at least one resistance portion which may be removable without damage to said energy absorbing connector.

In a still further embodiment, disclosed herein is a ball glove comprising: a hand portion including a thumb stall, an index finger stall, and a crotch between the thumb stall and the index finger stall; a webbing; and connector means for suspending or supporting the webbing in the crotch of the hand portion such that when a ball is caught in the ball glove the connector means converts kinetic energy imparted by the ball into energy of a different form which is then not converted back into kinetic energy reimparted to the ball.

BRIEF DESCRIPTION OF THE FIGURES

FIG. 3A shows the web prior to the catching of a ball. FIG. 3B shows the web after catching of a ball.

FIG. 4A shows a perspective view. FIG. 4B shows a side cutaway view. FIG. 4C shows a top view.

DETAILED DESCRIPTION OF PREFERRED EMBODIMENTS

Although the ball glove described below is discussed primarily in terms of playing the game of baseball, it would be understood by one of ordinary skill in the art that ball gloves of the type described can be used in a wide variety of sports including baseball, softball, or other sports. In addition, although the ball glove discussed below will be discussed primarily as being used by younger male and female players, it should be clear that the benefits of such a glove, while possibly clearer for younger players, could be utilized by players of any age, sex, or skill level.

Also, although the ball glove will be discussed primarily in terms of being used for fielding, the benefits of improving the ability to catch a ball can be utilized by every player on a baseball field for any type of catching activity whether in a game, in practice, for fun, or under any other situation. One of ordinary skill in the art would understand that the concepts and devices described herein could be used on a glove for any position on a team, and can provide benefits to any activity performed where the ability to maintain a ball in the possession of a player is desired.

Further, this discussion will regularly make use of the phrases "dissipating" or "absorbing" of energy. These terms are generally taken to mean that the energy imparted by the ball (generally the kinetic energy of the ball) is converted into a form which is then not converted back into energy reimparted to the ball after the ball has impacted the glove. That is, the energy is "lost" to the ball and the energy is not used by the ball to move away from the glove after impact. Some energy will always be lost in any collision as it is converted to heat or to other forms of energy not related to motion of the ball. In this discussion, the energy will generally be lost because it is used to perform an activity at the energy absorbing connector instead of being stored and used to "bounce" the ball out of the glove. In particular, this energy will generally be described herein as being used to move portions of the glove between two states. These explanations, however, are by no means intended to limit the scope of any terms as would be understood by one of skill in the art.

Figure 1:
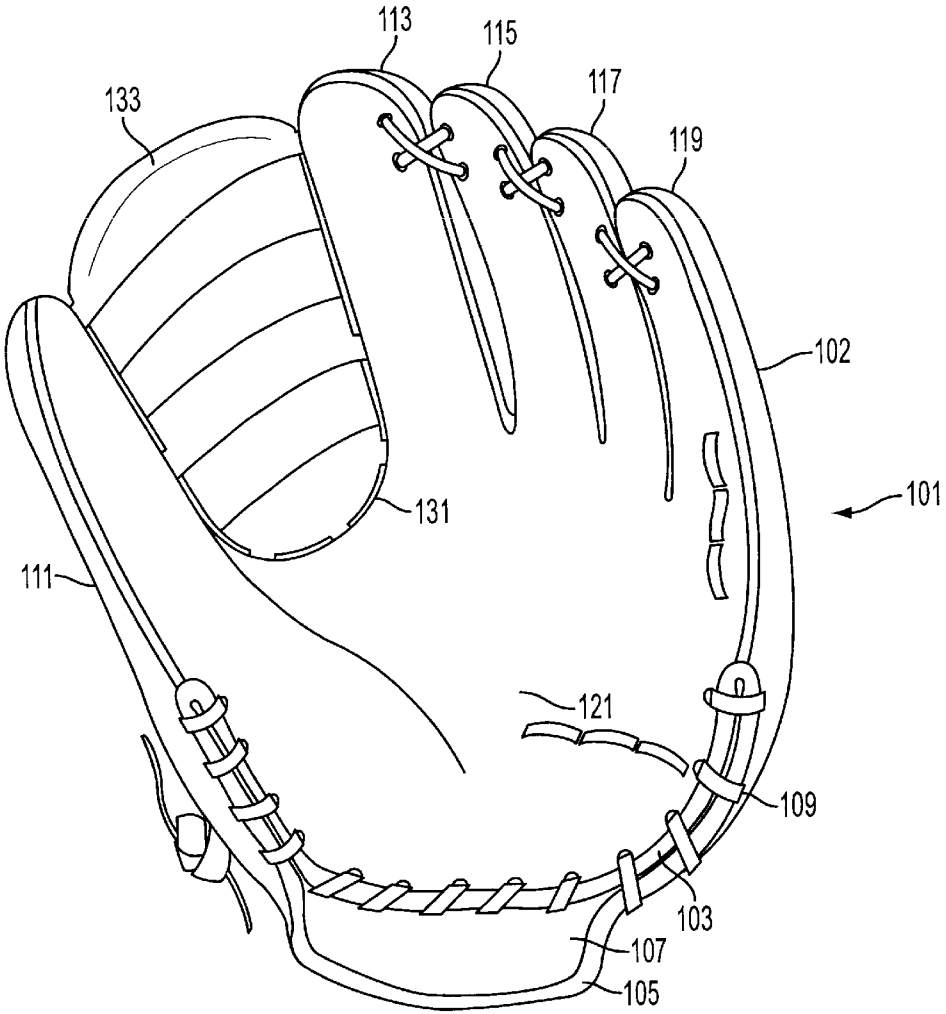
FIG. 1 provides a front perspective view of an embodiment of a baseball glove incorporating an embodiment of a dynamic web.
Figure 2:
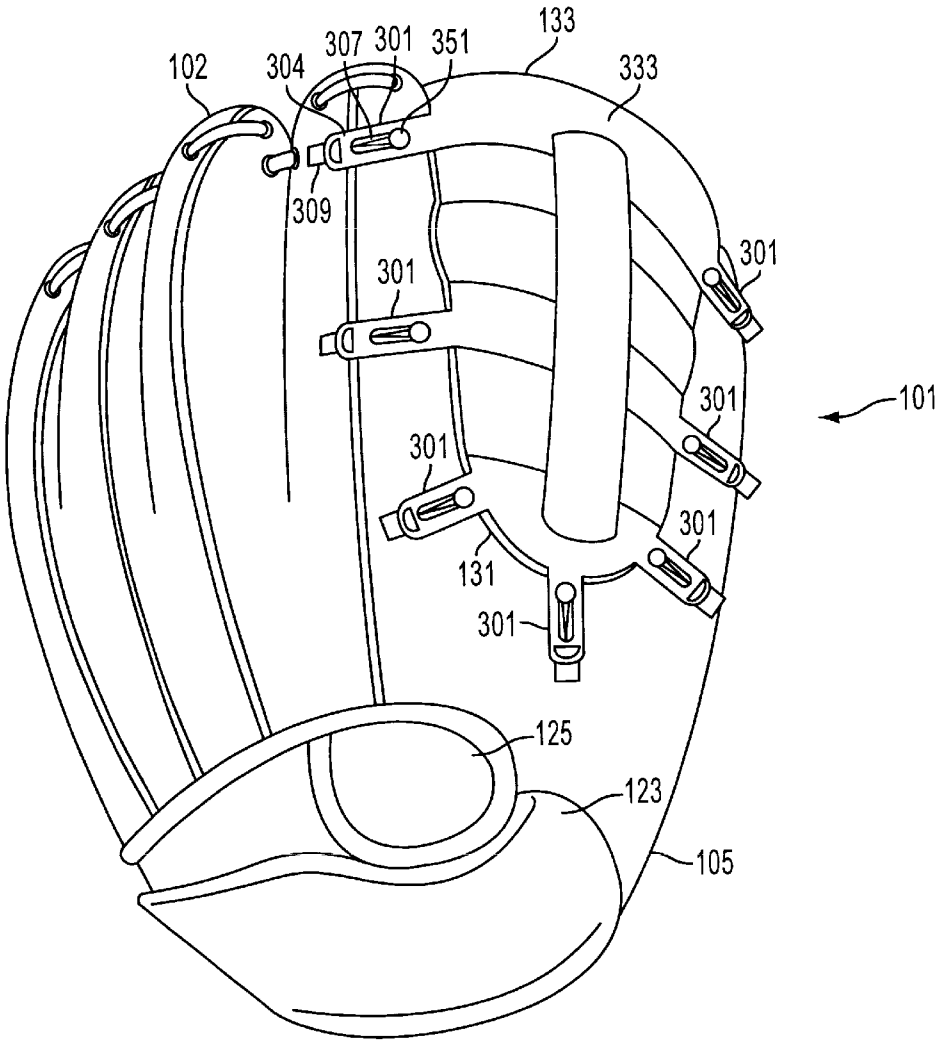
FIG. 2 provides a rear perspective view of an embodiment of a baseball glove incorporating an embodiment of a dynamic web.

FIG. 1 and FIG. 2 provide an embodiment of a ball glove (101) with a dynamic web (133). The glove (101) generally consists of two halves, a front half (103) and aback half (105) which are attached together (such as by stitching (109)) to form a chamber (107) into which the hand is placed when the glove (101) is used. So as to provide strength with which to grip the ball when it is being caught, the glove (101) generally has a plurality of individual stalls into which the fingers are inserted when the glove (101) is in use. These include thumb stall (111), index finger stall (113), middle finger stall (115), ring finger stall (117), and little finger stall (119). To provide additional strength for catching the ball, some of these finger stalls may be attached together in an embodiment allowing fingers to provide force cooperatively instead of independently. This means that each moving part of the glove is stronger than it would be if each finger stall could move separately. In an embodiment, the little finger stall (119) may be attached (sewn) to the ring finger stall (117) making a so-called "four finger" glove. One of ordinary skill in the art would understand that alternative arrangements of finger stalls can be used and some ball gloves have no fingers attached together, while other ball gloves have additional or alternative fingers attached together. The ball glove (101) also includes a palm portion (121) which covers the palm of the hand, a strap portion (123) on the back of the hand to hold the glove (101) in place (and possibly to resize the glove) and possibly a hole or cutout (125) to increase flexibility. All these portions together define a hand portion (102) of the glove (101).

The glove (101) also includes a dynamic web (133) upon which the ball is caught when the glove (101) is used. When a ball is fielded it is often traveling with a very high velocity, and can injure the body if it impacts into it directly. By catching the ball in the dynamic web (133), the ball can be caught without the ball hitting the hand (or anything on the surface of the hand) but hitting only the material of the dynamic web (133). The dynamic web (133) is positioned to cover or enclose the space between the thumb stall (111) and index finger stall (113) which is commonly called the crotch (131). The crotch is generally not more than 4½" at the top, not more than 5¾" tall and not more than 3½" wide at its bottom which conforms to generally accepted league standards in baseball and softball. The dynamic web (133) comprises a piece of webbing (333) which is suspended to cover the area of the crotch (131) and will generally be sized to be of similar dimensions to the crotch (131), while being attached to the glove through a plurality of energy absorbing connectors (301). This webbing (333) is generally comprised of a resilient yet flexible material so that when the ball impacts the webbing (333), the material stretches and/or otherwise deforms to absorb some of the force from the ball impacting the webbing (333). Although virtually any type of material can be used, the webbing (333) is often made up of leather or other animal hide, plastics, or fabric materials so as to be both flexible and strong enough to accept the full impact of the ball without ripping or permanently deforming. In an embodiment, the webbing (333) of the dynamic web will be manufactured and constructed similarly to a traditional web used in a traditional glove, but the attachment of the webbing (333) to the glove (101) will be different from the attachment of a traditional web. When catching a ball, the player lines up the crotch (131) with the incoming ball, and when the ball hits the dynamic web (133) the dynamic web (133) retracts a predetermined distance as the fingers are closed across the palm and toward the thumb retaining the ball in the dynamic web (133) (and/or pocket) of the glove (101).

As discussed above, for younger or more inexperienced players, the act of closing the glove in time to catch the ball is not always easy (as is regularly demonstrated by individuals trying to handle fly balls). The problem is often two-fold. Firstly, younger or more inexperienced players are likely to have newer equipment, or equipment that has not been broken-in through repeated use. Secondly, these players are less likely to have the correct split second timing required to regularly close their hand to trap the ball in the pocket of the glove. The result of these issues is that a younger player will often close their glove a split second too late resulting in the ball bouncing from the glove and being dropped instead of caught.

Generally a ball does not fly out of the glove, but bounces out of the glove with a much diminished force. This results from the stretching of the materials of the web, the motion of the glove, the motion of the arm, and the ball's compression all being fairly inelastic and/or inefficient at returning the impact energy of the ball to the ball so most of the ball's energy is spent on heat, friction, and other motion. It is this absorption without retransmission of the force of the baseball which makes catching the ball much easier with the glove than with the a bare hand when a player knows how to use the glove well.

The dynamic web (133) is designed to absorb additional force compared to a traditional web and to increase the time that the ball is in the pocket of the glove before it has regained sufficient energy to bounce out of the pocket of the glove. In this way, catching the ball is made easier. In an embodiment, the dynamic web (133) absorbs more impact by suspending the webbing (333) in the crotch (131) using at least one energy absorbing mechanism such as a multi-position or moving connector or what is referred to herein as an energy absorbing connector (301) instead of rigidly attaching the web to the glove.

The use of the term "energy absorbing connector" herein does not require that a connector of the shape or style shown in the FIGS. be used. In another embodiment, the energy absorbing connector could surround the webbing in an unbroken connection, or could be of any other shape or structure that attaches the webbing (333) to the hand portion (102) and absorbs, dissipates, or otherwise reduces the energy of the ball by transferring the energy of the ball into some other form of energy through the design of the connector. The use of the term "energy absorbing connector" is simply a way of identifying a point at which energy can be absorbed by the dynamic web of this invention.

It would also be understood by one of skill in the art that the energy absorbing connectors (301) described herein are merely some of a plethora of energy absorbing connectors which could be used to allow movement of webbing (333) to dissipate, absorb, or otherwise prevent energy from being returned to the ball and may be used by the energy absorbing mechanism to "absorb energy." They would also understand that movement is merely one of a plethora of different energies which could be used to prevent energy from being returned to the ball. Any energy absorbing mechanism which prevents energy from being provided back to the ball by instead using or converting that energy for something else, can be used as an energy absorbing connector. For instance, the energy absorbing connectors (301) could comprise materials where a chemical reaction occurs when exposed to energy of motion releasing heat, even if the dynamic web (133) does not physically move. Further, the reaction could be electrical, chemical or anything else instead of mechanical (for instance forcing apart magnetic fields, generating electrical current, or performing chemical reactions could be used to dissipate energy).

These explanations are, however, by no means intended to limit the scope of these terms as would be understood by one of ordinary skill in the art.

Further, the following terms will generally be used in the following manner. A "web" refers to the material suspended through a generally immobile connector in a traditional ball glove, a "dynamic web" refers to the combination of "webbing" which is generally similar to a "web" and an "energy absorbing connector" which allows more energy to be dissipated through the interacting of the "webbing" and the rest of the glove than that which is dissipated by the generally immobile connector used with a traditional "web".

Traditionally, the web has been rigidly attached to the finger stalls and palm portion abutting the crotch by being sewn into place. In the instant embodiment, however, the webbing (333) of the dynamic web (133) is suspended in the crotch (131) by at least one energy-absorbing connector (301) which allows for the additional absorption of force from the ball. In particular, the embodiment shown in the FIGS. transfers energy from the ball, into energy to move the webbing (333) between positions or states. The webbing (333) is suspended in the crotch by at least one energy absorbing connector (301) attached to the webbing (333) which may be the only place the dynamic web (133) is attached to the hand portion (102). These energy absorbing connectors (301) are comprised of a pin harness portion (304) including a slot (307), a pull portion (309), and a pin (351). In an embodiment, the webbing (333) is suspended by the energy absorbing connectors (301) from behind the crotch (131), therefore the connection between the dynamic web (133) and the hand portion (102) of the glove (101) occurs on the back half (105) as shown in FIG. 2. Although this back suspension is preferred (as it places the energy absorbing connectors (301) on the back of the hand portion (102) where they cannot be hit by the ball) it is by no means required, and, in other embodiments, the energy absorbing connectors (301) are connected to the front half (103) and/or at the transition point between the front (103) and back (105) halves. In the depicted embodiment, the suspension of the webbing (333) by the energy absorbing connectors (301) allows for the webbing (333) to move between a plurality of different positions, wherein that motion absorbs energy from the ball.

Figure 3A:
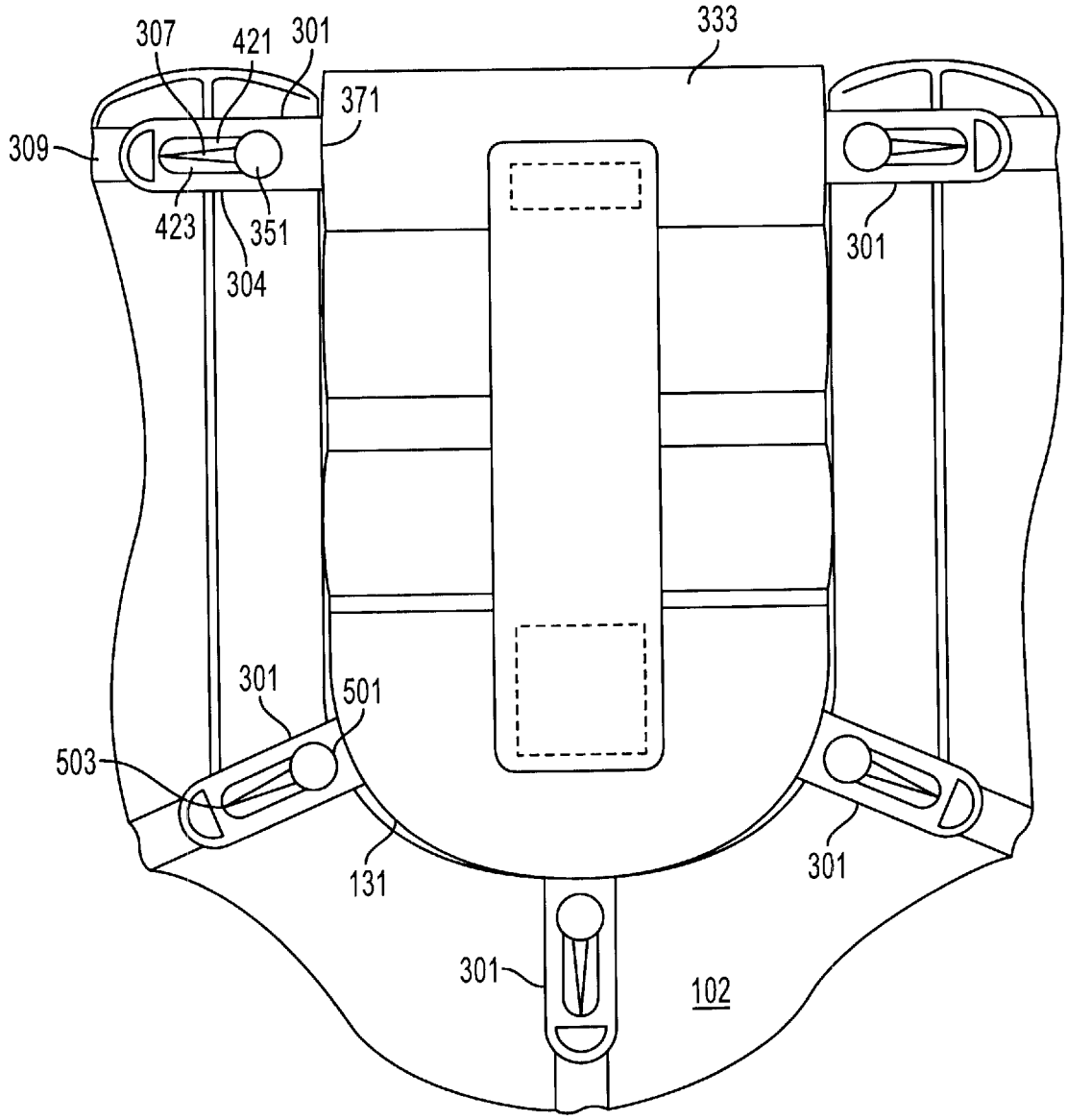
FIGS. 3A and 3B provide a detail view of the motion of the dynamic web shown in FIG. 1 and 2.
Figure 3B:
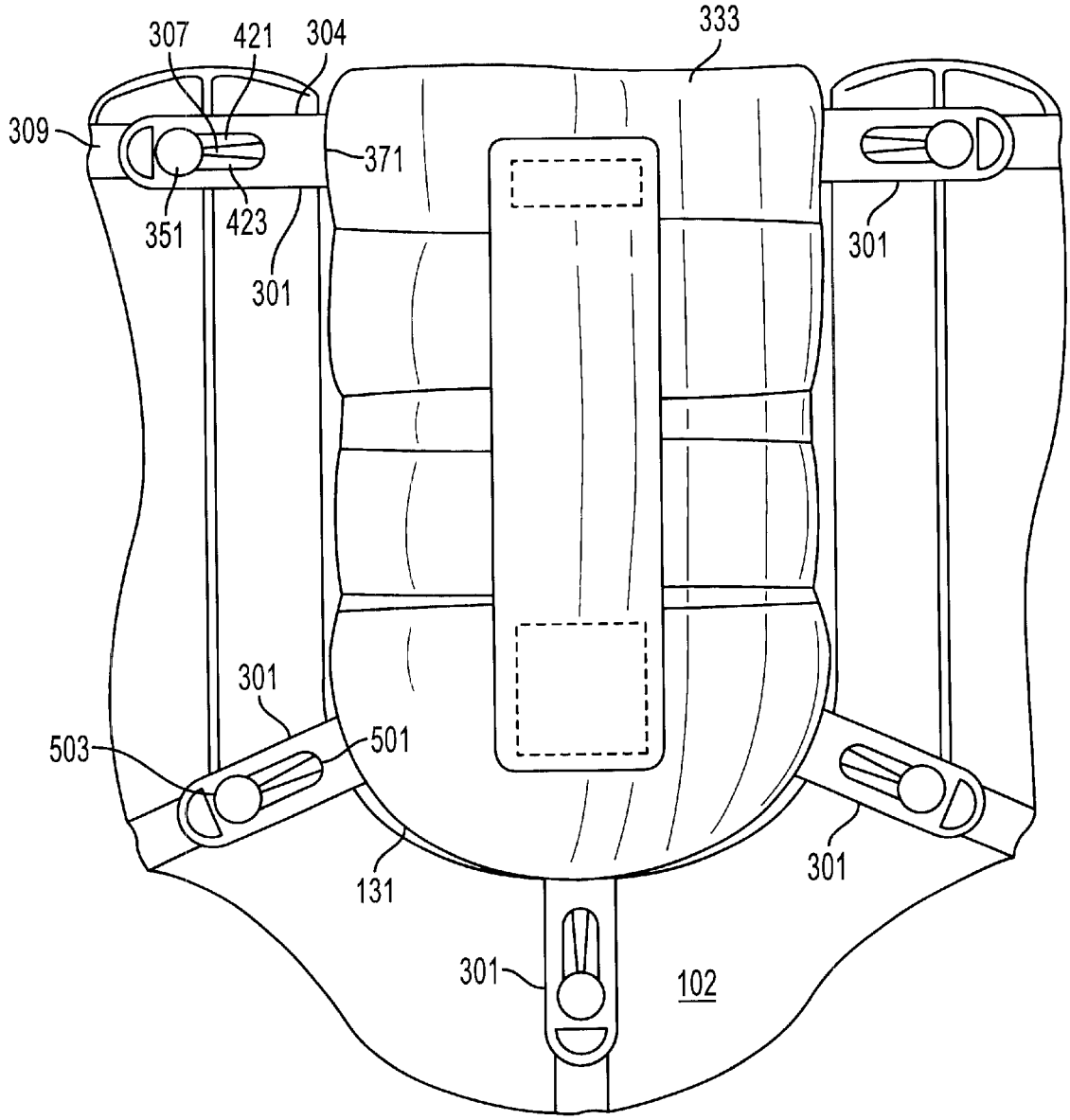

FIGS. 3A and 3B show a close up view from the rear of the glove (101) and the attachment of the dynamic web (133) to the hand portion (102) by the energy absorbing connectors (301). In an embodiment, the energy absorbing connectors (301) absorb energy by taking the energy of impact and dissipating it by forcing a pin (351) through pin resistance materials (421) and (423) mounted in a slot (307) in a pin harness (304). The energy absorbing connectors (301) of this embodiment therefore dissipate additional energy through the use of resisted movement and work as follows. The pin harness (304) is attached around the pin (351) so that the webbing (333) is suspended in the crotch (131) and can move between two different states or positions (individually shown in FIGS.3A and 3B). The pin harness is designed so that there is friction or other resistance resisting the motion of the pin (351) through the slot (307), such as through the use of pin resistance materials (421) and (423). Therefore, it takes a certain amount of energy to move the pin (351) through the slot (307) a predetermined distance. The dynamic web (133) is placed in a first state (or position) relative to the rest of the glove (101) with the pin (351) in a first position in the slot (307) prior to catching the ball (as shown in FIG. 3A). When the ball impacts the dynamic web, the force of its impact moves the dynamic web (133) towards the second state (or position) where the pin (351) is in a new, second position in the slot (307) after impact (such as that shown in FIG. 3B). This allows some of the energy of the ball to be dissipated because the energy is used up moving the pin (351) through the slot (307) and cannot be returned to the ball. It should be recognized that the energy of the ball is not lost, it is simply transferred to something that does not return the energy to the ball (in this case, motion of the components of the dynamic web (133) and heat (friction)). It should also be recognized that it is not necessary for the force of the ball to move the dynamic web (133) all the way from the FIG. 3A position to the FIG. 3B position. In an embodiment, any motion of the pin (351) in the slot (307) in any direction can be used to dissipate energy.

An embodiment of how the energy absorbing connector (301) connects the webbing (333) to the glove (101) is shown in FIGS. 3A, 3B, and 4. In particular, the webbing (333) is suspended by energy absorbing connectors (301). Each energy absorbing connector (301) has at least one pin harness (304). The pin harness (304) has a slot (307) that is of a generally elongated shape and extends through the main portion of the pin harness (304). Each pin harness (304) engages a pin (351) which can slide through the slot (307) in a direction generally parallel and coplanar to the slot, but is preferably prevented from substantial motion in any other direction. It is also preferable that the pin (351) not be separable from the slot (307) under normal game conditions. The webbing (333) is held in place in the crotch (131) because the pins have a limited amount of total movement (they can only move back and forth in the slot) thereby forcing the webbing (333) to also have a limited movement relative to the hand portion (102) of the glove (101). Therefore, the movement of the webbing (333) can be used to dissipate energy while the movement is still within controlled boundaries preventing the glove (101) from being disallowed from play, or from having to be used in a manner inconsistent with the use of a traditional glove. In particular, during a game, the webbing (333) will only assume a position where each pin (351) is within its respective slot (307) so the webbing's (333) possible positions can all be determined by the number of pins (351) and the size of slots (307).

Figure 4A:
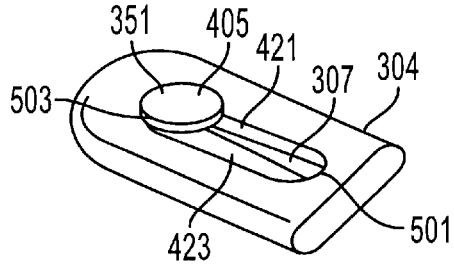
FIGS. 4A, 4B and 4C show detail views of embodiments of energy absorbing connectors such as that used by the embodiments of FIGS. 1–3.
Figure 4B:
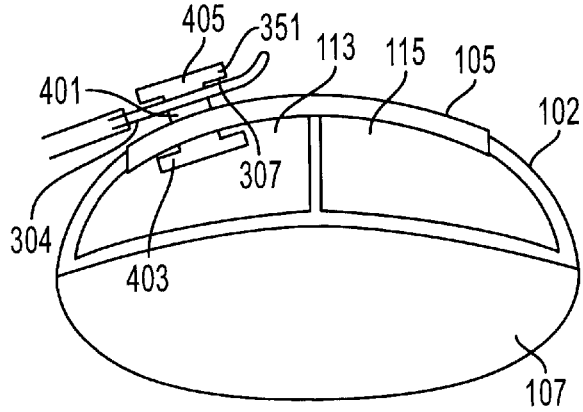
Figure 4C:
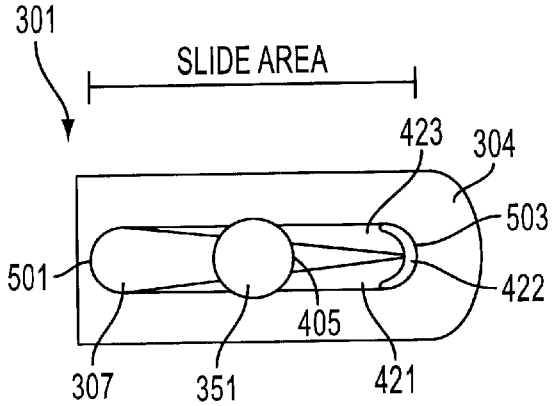

An embodiment of the engagement between the pin (351), the pin harness (307), and/or the body portion (102) is shown in the detailed drawings of FIGS. 4A, 4B, and 4C. In this embodiment, the pin (351) and pin harness (304) are designed so as to provide for a known, limited movement along a generally linear path parallel to the slot (307). In FIG. 4A, detail of the pin (351) and pin harness (307) is shown in perspective. In FIG. 4B, a cutaway side view is shown, while FIG. 4C shows a top down view including the limitations on motion. The pin (351) will generally be constructed of a resilient material that is quite rigid so as to be able to withstand repeatedly impacting the ends (501) and/or (503) of the slot (307) without bending or breaking.

This material can include, but is not limited to, leathers, plastics, rubbers, woods, or metals. The pin (351) generally comprises three components, a shaft (401), a base (403), and a head (405). The base (403) will generally be attached to the ball glove (101) to hold the pin (351) in place on the hand portion (102). This will generally be a rigid or non-moveable attachment so that the pin (351) does not move relative to the hand portion (102) and is maintained in a manner so that the shaft (401) of the pin is generally perpendicular to the surface to which the pin (351) is attached. In the depicted embodiment, this is the back half(105). This attachment may be through any method understood by one of ordinary skill in the art such as sewing, adhesives or single piece construction. FIG. 4B however, shows an embodiment where the base (403) of the pin (351) is significantly larger in diameter compared to the shaft (401). The shaft (401) is then placed through a hole in the back half (105) of the glove (101) with a diameter roughly equal to or slightly larger than that of the shaft (401), but less than the diameter of the base (403). The base (403), therefore, cannot pass through the hole and is held in place on the inside of the chamber (107) of the hand portion (102) while the shaft (403) extends through the hole in the back half (105) and extends in a generally perpendicular direction from the hand portion (102). In the embodiment of FIG. 4B, the base (403) may also be secured to the back half (105) inside the chamber (107).

The pin harness (304) is also placed so that the shaft (401) of the pin (351) extends through the slot (307). The pin harness (307) will preferably be a strong, yet flexible material such that the material will not readily break from impact with the pin (351) while still being flexible enough to bend along its longer dimension from the force of the ball. Ideally, the material is also relatively inelastic, will remain in a position after moved there, and will not deform in a manner that would allow for the pin head (405) to be pulled through the slot (307) from the force of a ball impact. The head (405) of the pin (351) is at the end of the shaft (401) opposing the base (403), and is also generally of a greater diameter than the shaft (401). The slot (307), generally has a width of a similar dimension to the diameter of the shaft (401) and smaller than the diameter of the head (403). The pin (351) is therefore generally a barbell shape with the back half (105) and the pin harness (304) on the shaft (401) of the barbell, and held between the two ends. Although the barbell shape has been described above with the shaft (401), base (403), and head (405), having generally circular or cylindrical shape, other shapes could be used as would be understood by one of ordinary skill in the art.

The pin harness (304) is preferably designed so that the head (405) of the pin (351) cannot be pulled through the slot (307) without force of either greater magnitude, or in a different direction to that which would be expected when catching a baseball. In particular, the material of the pin harness (304) should be resilient enough to prevent the head (405) of the pin (351) from being pulled through the slot (307). This material could include, but is not limited to, plastics, leathers or other animal hides, fabrics, metals, or any combination of these materials.

In an embodiment, however, the dynamic web (133) can be separated from the rest of the glove (101) by a player purposefully attempting to do so. This could be to perform maintenance on the glove (such as oiling) or to repair or replace a damaged component of the hand portion (102) or dynamic web (133). In particular, in an embodiment, the head (405) of the pin (351) can be fit through the slot (301) like a button through a button hole. That is, one or both of the long edges of the slot can be deformed by the player to allow the head (405) to pass through the slot (307) and separate the dynamic web (133) from the rest of the glove (101). This allows the dynamic web (133) to be easily replaced if it should become damaged. As will be described later, the material at the far end (503) of the slot (307) will repeatedly be subjected to heavy shocks and large forces as the ball impacts the dynamic web (133). Therefore, the material of a pin harness (304) may tear, wear out, or become weakened after repeated use. If this occurs, instead of having to replace the entire glove (101) the player could remove the damaged web (133) and replace it with a new one. This could even be performed during a game if necessary, as the web generally requires less breaking-in compared to the hand portion (102). Further, this can preserve the life of a hand portion (102) leading to less need to break-in new equipment. In addition to the button-type connection described above, one of ordinary skill in the area would understand that other types of connections can be used to perform a similar function.

In yet another embodiment, this feature can be used to make a convertible glove. For example, the same hand portion (102) could be used with a smaller dynamic web (133) to make an infielder's glove or a larger dynamic web (133) to make an outfielder's glove. In still another embodiment, the dynamic web (133) could be chosen to compensate for a particular batter that is expected in the next batting series or to prepare for facing a particular team. In still another embodiment, the dynamic web (133) could be chosen based on the fielder's current ability or status, so as to compensate for an injury, or even to change as the player becomes fatigued as the game progresses.

As shown in FIG. 4C, the energy absorbing connector (301) is designed so the slot (307) slides in a generally linear fashion around the pin (351) with the pin passing through the slot (307). As shown in FIGS.3A and 3B, the webbing (333) attached to the energy absorbing connector (301) can move relative to the hand portion (102) by pulling on the energy absorbing connector (301) at a near end (371) and forcing the pin (351) from the near end (501) of the slot (as in FIG.3A) to slide through the slot (307) toward the far end (503) of the slot (307) (as in FIG. 3B). With a single pin harness (304) and pin (351) combination, the webbing (333) could slide in any direction so that at least a portion of the force pulled, or pushed, the pin (301), in a linear direction parallel to the slot (307) and where the pin (351) is in a position to slide (this is indicated relative to FIG. 4C). One of ordinary skill in the art would recognize that since the webbing (333) may be attached to the energy absorbing connector (301) through flexible connections, a force in basically any direction on the webbing (333) may result in some component of that force being translated to motion parallel to the slot (307). This is particularly true if the pin harness (304) was designed to be flexible. In an embodiment, a single energy absorbing connector (301) is used on the thumb stall (111) side of the crotch (131) with a solid stitching on the index finger stall (113), the ball hitting the webbing (333) would translate some of the force of the ball into the webbing (333), pulling on the tab on the thumb stall (111) side and the stitching on the index finger stall (113) side. Some of the thumb stall (111) force would be dissipated by the movement of the pin (351) through the slot (307), while the index finger stall (113) side would be only lost to friction, stretching, or bending of the stitching.

In the embodiment shown in FIGS. 3A and 3B, there are a plurality of energy absorbing connectors (301) and therefore a plurality of pin harnesses (307) and pins (351) holding the webbing (333) in place. In addition, these energy absorbing connectors (301) are arranged so that the slots (307) are all in a generally perpendicular direction to the crotch (131). The easiest way to look at this is to state that each slot (307) has two ends. A near end (501) which is at the point closest to the crotch (131) and a far end (503) which is at the point of the slot (307) farthest from the crotch. With this layout, the dynamic web (133) moves with the ball such that the webbing (333) moves in a generally linear fashion into and out of the crotch (131) as shown in FIGS. 3A and 3B, because the multiple slots (307) limit the motion of the webbing (333) in the plane of the crotch (131) through their interaction with each other.

It would be recognized by one of ordinary skill in the art that this description repeatedly talks about the pin (351) moving through the slot (307). However, the movement of the webbing (333), because of its connection to the pin harness (304), actually moves the slot (307) relative to the pin (351). It is to be understood that either motion is essentially the same and is purely dependent on the frame of reference. Therefore, moving the pin (351) through the slot (307), or moving the slot (307) relative to the pin (351) are the same motion and are used interchangeably herein.

In an embodiment, the friction between the pin harness (307), and the outer surface of the pin (351) is where most of the energy is absorbed from the impact of the ball. As is shown in FIGS. 4A through 4C, various portions of the pin (351) are in contact with the pin harness (304) material that surrounds the slot (307). In an embodiment, the friction and surface tension between these two items is sufficient to absorb energy from the ball, but in another embodiment, the friction generated by this interaction is not sufficient to result in a marked improvement in catching performance. Therefore, as shown particularly in the embodiments of FIGS. 5A and 5B, pin resistance portions (421) and (423) are placed so that the pin must "pull-through" the pin resistance portions. These pin resistance portions (421) and (423) are pieces of material that are placed within the slot (307) or otherwise on the pin harness (304) so as to be in surface contact with the outer surface of the pin shaft (401). These materials are generally selected so that there is a high friction and/or resistance between the shaft (401) of the pin and the pin resistance portions (421) and (423) or generally so that the pin (351) must expend a large amount of energy to move (for instance by compressing the material). For this reason, the pin resistance portions (421) and (423) are often constructed of a material having a particularly high coefficient of friction with the material of which the shaft (401) of the pin (351) is constructed or may be manufactured with a certain construction to require a lot of force to pass through, for instance by forcing the compression, bending, or other displacement of the pin resistance material.

Figure 5A:
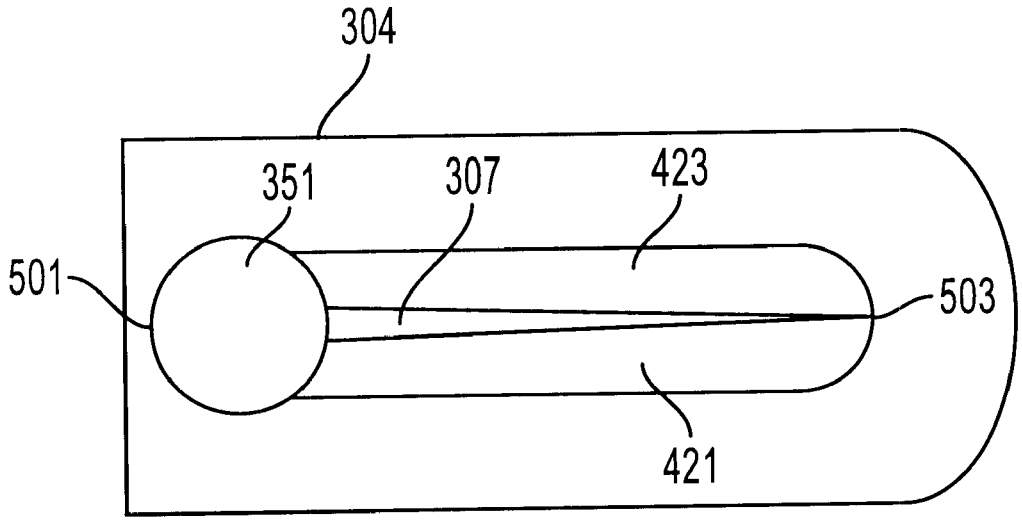
FIGS. 5A and 5B show detail views of different embodiments for creating friction or otherwise forcing the pin to expend energy to move within a pin harness in the embodiment of an energy absorbing connector, such as that shown in FIGS. 4A–4C.
Figure 5B:
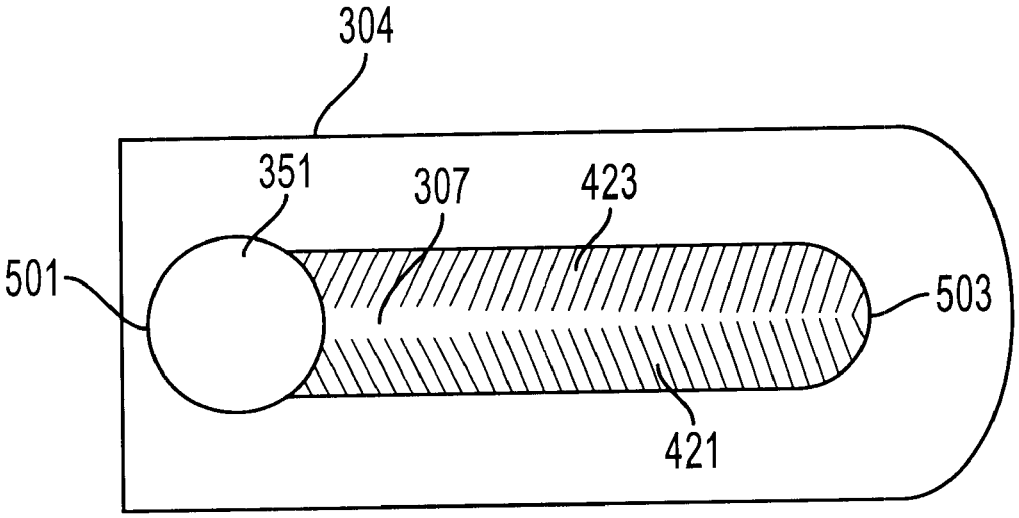

FIG. 5A shows one embodiment of pin resistance portions (421) and (423) where the portions are of a relatively rigid material placed in a "V" shape which must be forced out of the way by the passage of the pin (351). The material can be virtually any type of material which can generate resistance and can include, but is not limited to, rubbers, elastomers, plastics, leathers or other animal hides, fabrics, or items including or supporting substances to increase friction or surface tension, such as gummy or sticky materials. The material may also be placed in a manner so as to press against the surface of the shaft (401). In this way the pin's motion must compress the material, and then needs to slide along it resulting in losses to compressive force.

FIG. SB shows an alternative embodiment where the pin resistance portions (421) and (423) comprise a mat of resilient parallel fibers connected at one end and where the other end points toward the near end (501) of the slot. In such a system, to move the pin (351) from the near end (501) to the far end (503) the pin (351) would have to bend the individual elastic fibers as it contacts their ends or sides while it gains no benefit from their resilient spring back as the pin (351) is not in contact with the fibers when they do so. However, to move the pin the other direction takes little force as the pin (351) simply compresses the fibers against the edge of the slot (307) and does not need to bend them. Because the ball is always caught with the same motion of the webbing (333) in an embodiment (in particular where the ball forces the pin (351) to move from the near end (501) toward the far end (503)), this type of one-way resistance can be used. Essentially, this is a ratcheting motion where the force to move the "ratchet" in one direction is much greater than to move it in the other. Other types of friction and energy using interactions which could be utilized in the energy reducing connector (301) would be understood by one of ordinary skill in the art. These can include, but are not limited to, springs or other objects for storing force, gearing or other mechanical mechanisms, or electromechanical interactions such as opposing magnetic fields.

Figure 6A:
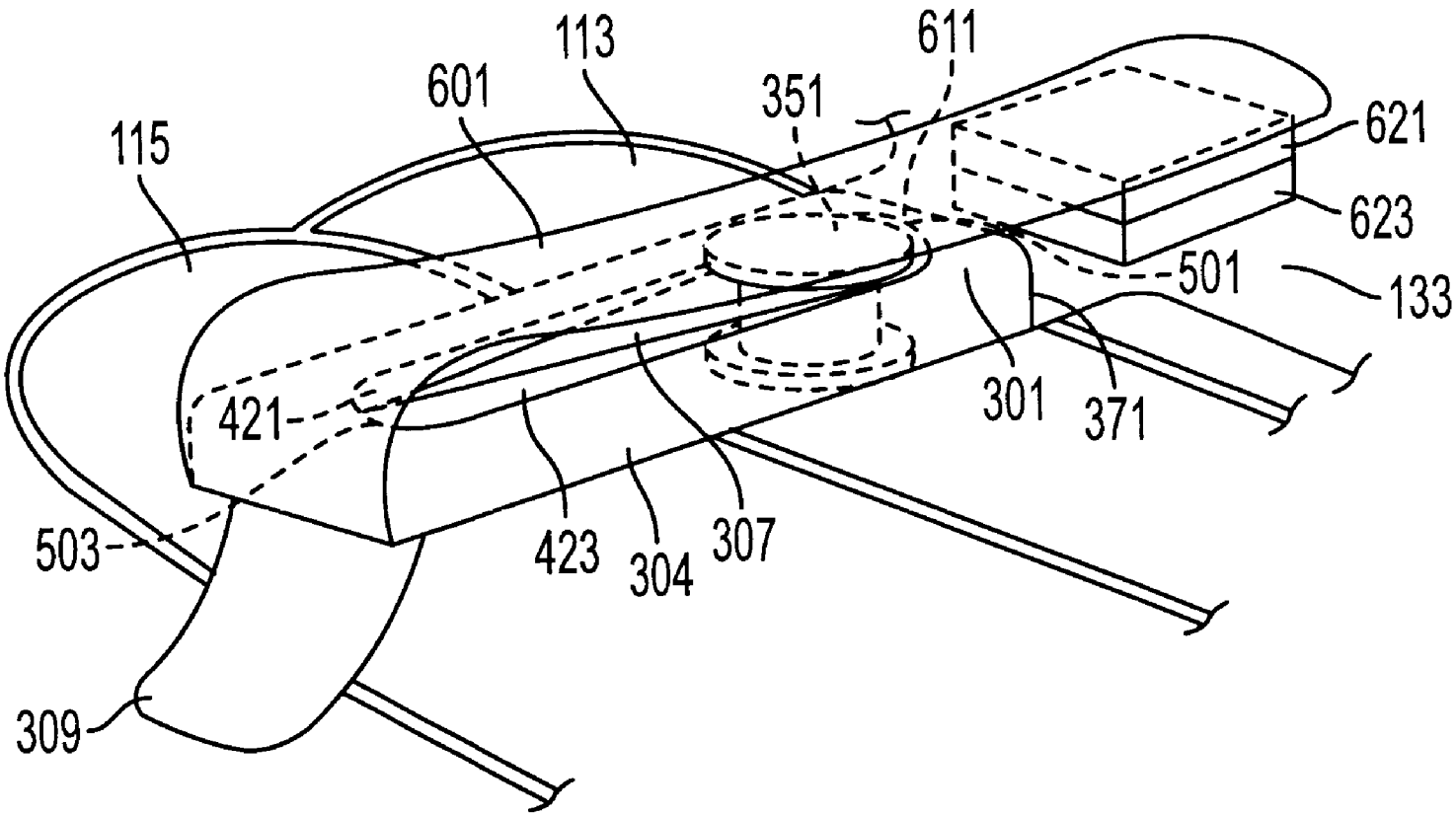
FIGS. 6A, 6B, and 6C show an embodiment of an energy absorbing connector which can be disassembled for repair or replacement of components.
Figure 6B:
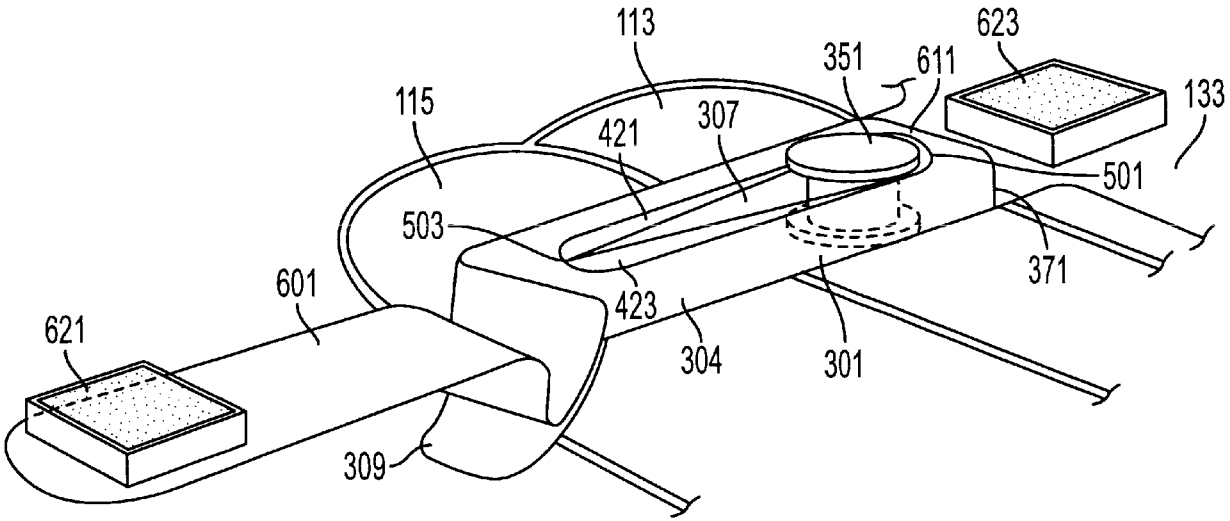
Figure 6C:
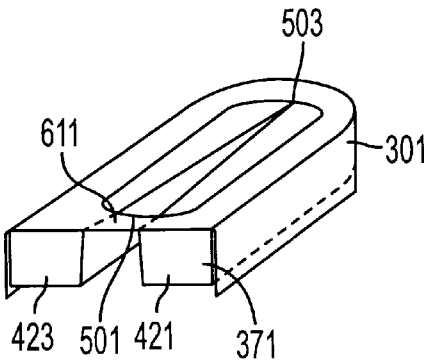

FIGS. 6A, 6B and 6C show the energy absorbing connector (301) of an embodiment which allows for the periodic replacement of the pin resistance portions (421) and (423) and/or repair or replacement of other components. The depicted embodiment, can also be used in conjunction with a glove system wherein multiple different dynamic webs (133) are used in conjunction with the same hand portion (102). FIG. 6A shows the pin harness (304) with an associated strap (601) in a closed arrangement such as would be used when a ball is to be caught. FIG. 6B shows the pin harness (304) with the strap (601) in an open arrangement such as would be used when removing the pin resistance portions (421) and (423) and/or separating the dynamic web (133) from the hand portion (102). FIG. 6C shows a reverse angle view of the pin harness (304), removed from the pin (351) and showing more detail about the open area and how the pin resistance portions (421) and (423) are removed.

In the depicted embodiment of the energy absorbing connector (301), the pin (351) is placed inside the slot (307) which is at least partially open at the near end (501). In the depicted embodiment, the near end (501) has a surface (611) which, in conjunction with the surface of the glove (101), or possibly another surface on the opposing side (not shown) allows for the pin harness (304) to maintain a generally rectangular shape even if constructed of flexible material. This surface (611) is, however designed to have little thickness allowing for the pin harness (304) to have a defined opening on the near end (371) (as shown in FIG. 6C). This allows for the pin resistance portions (421) and (423) to be removed by pulling on them at the near end so that they can be pulled from the pin harness (304) (pulled to the reader's left and out of the page in FIG. 6C). The far end (503) of the slot (307) is normally closed and in the slot are shown the two pin resistance portions (421) and (423) which, in this embodiment, are depicted as having a "V" shaped layout. This closed end allows for the impact of the pin, when a ball is caught, to have a strong resilient surface to impact upon.

In another embodiment, the far end could also be open. As opposed to the far end (503), the near end (501) is generally not impacted by the pin (351) when the ball is caught and is generally only impacted when the glove is adjusted prior to catching (such as by the player pulling on the pull portion (309)). Since the force that the pin impacts on the near end (501) may therefore be controlled by the player (and may be eliminated with certain types of use), the near end (501) can generally be built with less strength and without as much fear of failure from the pin (351) ripping through the pin harness (304). In the depicted embodiment, attached to the far end of the pin harness (304) is a strap (601) which is generally flexible and is generally just slightly longer than the length of the pin harness (304). This strap (601) contains a first fastener portion (621). In the depicted embodiment, this is adjacent to the non-attached end of strap (601), but in other embodiments this could be placed anywhere on the strap (601). There is then a mating fastener portion (623) which is mounted on the glove near the near end (501) of the slot (307). In an embodiment these fastener portions could be mating strips of a hook and loop (or similar) fastener, or any other type of mating fastener portions.

When in use, the strap (601) is pulled to cover the upper surface of the pin harness (304) so that the two fastener portions (621) and (623) can mate with one another securing the strap (601) in place as shown in FIG. 6A. Further, since the strap (601) extends beyond the near end (501) of the slot (307), the fastener portions act to "seal" or close the open end of the slot (307). When the glove is not in use, the fastener (621) and (623) portions may be separated, and the strap (601) pulled back (as shown in FIG. 6B). This allows access to the pin resistance portions (421) and (423) and other structure of the energy absorbing connector (301) as discussed previously. In an embodiment, when in the configuration of FIG. 6B, the pin resistance portions (421) and (423) may be removable from the energy absorbing connector (301), the pin (351) may be able to slide from the slot (307) separating the dynamic web (133) from the hand portion (102), and/or other maintenance or repair may be able to be done on the energy absorbing connector (301).

Returning to FIGS.3A and 3B, the operation of the dynamic web (133) when the glove (101) is being used to catch a ball can now be described. The glove (101) is prepared prior to the ball being hit, generally before the pitch is thrown. During preparation, all the pin harnesses (304) are adjusted so that the pins (351) are against the near end (501) of the slot (307) as shown in FIG. 3A. This may be done by a plurality of different methods, but in the depicted embodiment it is performed by pulling on a the pull portion (309) which is attached towards the far end (503) of the slot (307). This adjusts the webbing (333) so that the webbing (333) is as flat in the crotch (131) as possible and may, in an embodiment, be in contact with the back side of the thumb stall (111), the outside edge of the crotch (131), and/or the index finger stall (113). The webbing (333) may also be pulled tight across the crotch (131). Since, in the depicted embodiment, the webbing material (333) is suspended in the crotch (131) only by the energy absorbing connectors (307), pulling on each pull portion (309) will also minimize or even eliminate any slack in the webbing (333) or any portion of the dynamic web (133) within the crotch (131).

When a ball is caught, the ball generally impacts the webbing (333) from the front of the glove (101) and travels toward the back of the glove (or in a direction out of the page of FIG. 3). This impact, therefore, places a force in that direction upon the webbing (333). In response to this force, the webbing (333) is pushed out of the page and conforms to the ball. The webbing (333) then imparts a force on the energy absorbing connectors (301) and the slots (307) are pulled past the pins (351) until, if there is sufficient force from the ball, the pins (351) reach the far end (503) as shown in FIG. 3B. At this time, the pin harnesses (304) can move no further, and the webbing (333) has the maximum slack. Further, the dynamic web (133), is now at its slackest point relative to the crotch (131). During the course of the transition form FIGS. 3A to 3B, the force of the ball is used to force the pins (351) through the slots (307) of the pin harnesses (304). Therefore, much of the force of the ball is lost in performing the work of moving the pins (351) and cannot be retransmitted to the ball for its motion out of the glove (101). This reduces the ability of the ball to rebound out of the glove (101) as the ball has less energy with which to rebound. Further, there is a discrete amount of time that it takes for the pins (351) to move from the near end (501) of the slot (307) to the far end (503). This period of time increases the total time that the ball is in the glove (101) and in a position where the closing of the fingers will trap the ball in the glove (101). Therefore it is easier to catch the ball.

To describe the motion of the dynamic web (133) another way, the dynamic web (133) is designed, in an embodiment, to move generally parallel to the horizontal line drawn through the palm of the wearer and at a generally right angle to a vertical line drawn through the index finger, base of the thumb, and the wrist of the player wearing the glove when the ball impacts the dynamic web (133). As it so moves, it is driven back and away from the outside edge of the thumb, crotch and index finger, pulling the slots (307) past the pins (351) and dissipating energy in that movement.

As is clear from FIGS. 3A and 3B, the far end (503) of the slot (307) will receive significant impact as the slot (307) is moved over the pin (351) and the pin (351) impacts the far end (503). For this reason, the far end (503) of the slot (307) may fail if the ball is hit particularly hard. For instance, it may tear, give way, or allow the head (403) of the pin (307) to push through the slot (307). For this reason, in an embodiment, the far end (503) of the slot may be reinforced by a highly resilient piece of material such as the metal reinforcer (422), shown in FIG. 4C. This helps the far end (503) survive repeated impacts without deformation, tearing, or other failures.

Further, in an embodiment, the energy absorbing connectors (301) are designed to have no resiliency in their movement, or bias toward any particular state or position. A biasing mechanism would generally be undesirable as it could store some of the force which could be reimparted to the ball if used to try and bias the dynamic web toward the state of FIG. 3A. In another embodiment, however, a biasing mechanism could be used. For instance, it could be designed to increase the time the ball is in the glove but not the force, or to rely on a ratcheting or other one-way mechanism to allow the energy to be stored in the biasing mechanism but only released once the ball is no longer in the glove (e.g. because the fielder has already retrieved it and thrown it to another player). In an embodiment, the movement of the energy absorbing connector (301) is designed to be completely wasteful, so the pin (351) only moves in the slot (307) if a force is applied in the appropriate direction. The embodiments shown in the FIGS. herein can provide for such a system.

The benefit of the dynamic web (133) can be compared to a traditional web to show the additional force reduction. The traditional web is usually attached to the crotch so as to have little or no movement when a force is placed upon it (in particular the web is usually sewn into the crotch.) When the ball impacts this web, the web itself stretches (as do the stitches) absorbing some of the impact, but the web remains attached in the same position as previously, it does not retract or move as the dynamic web (133) does. The traditional web does not connect using energy absorbing connectors (301). Once the dynamic web (133) has reached a point where all the pins (351) are against the far end (501), the dynamic web (133) is essentially a traditional web attached by the pin (351) and pin harness (304) combination which cannot move any farther (in the same way the traditional web is attached by the stitching). Therefore, the dynamic web (103) dissipates more force because energy absorbing connectors (301) dissipate energy in addition to that which would be absorbed by a traditional web. Further, in an embodiment, the dynamic web (133) can be in the same position as a traditional web when in the position shown in FIG. 3B (that is, its most slack position) and after the energy absorbing connectors (301) have already dissipated some of the ball's energy. In this way, the additional force dissipation should be approved for use in all ball games, as the pocket of the glove is not actually increased through the use of the dynamic web (133) while the force is reduced due to the force dissipated by the transition from the position of FIG. 3A to FIG. 3B. Further, in an embodiment, in the state of FIG. 3A the webbing (333) is stretched taut in the crotch. This would be undesirable in a traditional glove because this structure would have less ability to absorb the force of impact because the web could stretch less (it is already stretched). In FIG. 3B, the dynamic web (133) may be in the same general tautness as a traditional web therefore acting just like a traditional web in this position, but having already dissipated some of the force of the ball by this time and improving performance.

It would be recognized by one of skill in the art that FIG. 3B could be used when the ball hits the glove, or a variation on FIG. 3B could be used (such as where the pins are in the positions of FIG. 3B, but the web extends into the pocket of the glove). While these may be used in alternative embodiments, they generally require more complicated structures to implement. For instance, if the dynamic web (133) begins in the hand portion (102), the energy reducing connectors (307) may move to push the slots (307) about the pins (351) instead of pulling them. One of ordinary skill in the art would recognize that this will generally require the pin harnesses (304) to be more rigid which may be undesirable. Further, one of skill in the art would understand that if the webbing (333) was slack (inward in the glove) when the ball hits, it will take a period of time when no energy is absorbed for the webbing to be pulled tight on the surface of the ball to begin placing forces on the energy absorbing connectors (301) which may not allow for as much energy dissipation. Therefore, in a preferred embodiment, the webbing (333) begins in its most taut position across the crotch (131) as described. Note, however, that even if the webbing (333) is in its most taut position, that does not require it to be taut; it simply presumes that there is additional slack at any other position.

The amount of additional force that is dissipated by the dynamic web (133) depends on how much force it takes to start the pin (351) moving through the slot (307) and, once the pin (351) is moving, move the pin (351) an additional distance in the slot (307). The total of all these would be the total force dissipated by the dynamic web (133) in moving all the pins (351) from the near ends (501) of the slots (307) to the far ends (503) of the slots (307) or the force dissipated by the energy absorbing connectors (301). The dynamic web (133) absorbs additional force from its stretching etc. but this may be roughly equivalent to that dissipated by the traditional web.

In a preferred embodiment, the amount of force that it takes to move the pin (351) from the near end (501) of the slot (307) to the far end (503) of the slot (307) is exactly equal to the amount of force the ball has. In this case, the ball will be perfectly stopped by the glove (101), and will only bounce out of the glove (101) if the force of gravity on the ball is sufficient (and in the correct direction) to pull it from the glove. Balls which are fielded, however, generally have a wide variety of different velocities, and therefore forces, associated with them.

In a preferred embodiment the energy absorbing connectors (307) provide for a varying force depending on the velocity with which the ball hits. A ball with more initial force, has more force dissipated. In an embodiment, since the dynamic web (133) acts similarly to a traditional web when it is in the position shown in FIG. 3B, the energy absorbed by the energy absorbing connectors (301) would preferably reduce the starting velocity of the ball to around the force of a ball which is generally safely caught by a baseball player of a particular skill level when the dynamic web (133) is in the state of FIG. 3B and the energy absorbing connectors (307) have absorbed all the energy they can. Therefore, an embodiment would have energy absorbing connectors (301) which dissipate force such that a certain high percentage of balls hit or thrown to the position played by that player are reduced in force to a force that is caught by that player a predetermined percentage of the time.

The force reduction can be proportional to the original force of the ball and of continual increase. For instance, a ball with X force could have a ½ reduction in force while a ball with 2 X force could have a ¾ reduction in force. There are many different mechanisms for force dissipation as would be understood by one of skill in the art. FIG. 5A however shows one in particular. In FIG. 5A the amount of resistance exerted by the resistance portions (421) and (423) increases as the pin moves from the near end (501) to the far end (503). This is accomplished through the resistance portions (421) and (423) being set up to provide higher friction and/or resistance at the far end (503) compared to the near end (501). In the depicted embodiment, the resistance material is slanted, or "V" shaped, so that there is less pressure between the shaft (403) of the pin (351) and the resistance portions (421) and (423) at the near end (501), while at the far end (503), the shaft (401) has to displace significantly more resistance material, displace some material a greater distance, and has more material in contact with it increasing the friction. Therefore, the amount of force to move the pin (351) a first distance (and dissipate some amount of force) is smaller than the force required to move the pin the next distance and so on. Such a system allows for an increasing amount of force which must be exerted by the ball at any instant. This leads to a sharper drop-off in the energy of the ball which can allow for a wider range of ball impacts to be reduced to a similar force. FIG. 5A is merely representative of an embodiment which could be used to increase the resistance as the pin moves through the slot (307). One of ordinary skill in the art would understand from this representation many alternative structures which could be used to obtain the same result.

In yet another embodiment, the energy absorbing connectors (301) could use a graduated scale so that a more inexperienced player's glove could absorb more force than that of a more experienced player. In an embodiment, multiple sets of pin resistance materials or dynamic webs (133) could be provided to cater to players of different skills so that a player could select what is appropriate for them and change as their skill improves, without having to purchase a new glove. In still another embodiment, a player of equal skill could select a particular set of pin resistance materials depending on the team, or even particular batters, they expect to face.

In a still further embodiment, the dynamic web (133) or energy absorbing connectors (301) could be supplied with an impact sensor in the webbing (333) or elsewhere in the glove (101) and a feedback (or feedforward) system where the amount of force it would take to move the pin (351) through the slot (307) is determined by the instant force that the ball is exerting on the glove (101) at any instant in time. In this way the force dissipated by the glove could be adjusted upon impact.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

What is claimed is:

1. A ball glove comprising:

a hand portion including a thumb stall, an index finger stall, and a crotch between said thumb stall and said index finger stall;

a pin attached to said hand portion;

a webbing; and a pin harness attached to said webbing, said pin harness slideably engaging said pin and positioned so as to suspend said webbing in said crotch.

2. The ball glove of claim 1 wherein said pin harness allows for generally linear movement of said pin within a slot.

3. The ball glove of claim 1 wherein said pin also slideably engages at least one pin resistance portion.

4. The ball glove of claim 3 wherein said at least one pin resistance portion is arranged so as to have a "V" shape.

5. The ball glove of claim 1 wherein slideable interaction between said pin and said pin harness requires a predetermined amount of force to accomplish.

6. The ball glove of claim 5 wherein said predetermined amount of force is generated by a baseball impacting said webbing.

7. The ball glove of claim 6 wherein force from said baseball is converted into force to accomplish said slideable interaction.

* * * * *